United States Patent [19]

Ochiai et al.

[11] Patent Number: 4,929,101

[45] Date of Patent: May 29, 1990

[54] RELEASE-TYPE DOT PRINT HEAD

[75] Inventors: Kuniaki Ochiai; Shigeo Komakine, both of Shizuoka, Japan

[73] Assignee: Tokyo Electric Company, Ltd., Tokyo, Japan

[21] Appl. No.: 357,776

[22] Filed: May 26, 1989

[30] Foreign Application Priority Data

May 27, 1988 [JP] Japan ..... 63-130002

[51] Int. Cl.[5] ..... B41J 3/10

[52] U.S. Cl. ..... 400/124; 101/93.05

[58] Field of Search ..... 400/124; 101/93.05

[56] References Cited

U.S. PATENT DOCUMENTS 4,537,520 8/1985 Ochiai et al. ..... 400/124

FOREIGN PATENT DOCUMENTS 0041126 9/1981 European Pat. Off. ..... 400/124

87062 5/1985 Japan ..... 400/124

*Primary Examiner*—Edgar S. Burr

*Assistant Examiner*—Ren Yan

*Attorney, Agent, or Firm*—Oblon, Spivak, McClelland, Maier & Neustadt

[57] ABSTRACT

A release type dot print head employing cores formed of a difficult-to-machine magnetic alloy containing iron and cobalt as the principal components and having a high saturation magnetic flux density. The cores are fabricated easily by processing plates of the magnetic alloy in a simple shape and are combined respectively with auxiliary cores formed of an easily workable material. Thus, the principal components of the release type dot print head can be easily fabricated and assembled.

3 Claims, 3 Drawing Sheets

RELEASE-TYPE DOT PRINT HEAD

BACKGROUND OF THE INVENTION

Field of the Invention and Related Art

The present invention relates to a release-type dot print head.

Release type dot print heads are well known. In a known release type dot print head, armatures biased in the printing direction by springs are attracted to cores placed respectively in solenoids by the magnetic force of permanent magnets, respectively, each armature is released by energizing the solenoid coil to cancel the magnetic force of the permanent magnet by the that of the solenoid coil so that the armature is moved in the printing direction by the spring to print a dot with a needle joined to the armature for character generation.

There has been strong demand for increasing the printing speed of dot print head regardless of type. To increase the printing speed of the release type dot print head, the force biasing the armature in the printing direction must be increased so that the armature is moved at an increased speed for printing when released, and hence the magnetic flux density in the space between the core and the permanent magnet must be increased accordingly. Japanese Patent Laid-open No. 60-87062 proposes a core and an armature formed of a magnetic alloy containing iron and cobalt as the principal components (Fe-Co magnetic alloy), having a high saturation magnetic flux density to establish a magnetic field of an increased magnetic flux density. An exemplary Fe-Co magnetic alloy contains 49% iron, 49% cobalt and 2% vanadium.

The core and the yoke disclosed in Japanese Patent Laid-open No. 60-87062 are unified in a single core-and-yoke member having a complicated morphology, which is difficult to fabricate and makes making most of the Fe-Co magnetic alloy difficult. When the core-and-yoke member is formed by sintering the Fe-Co magnetic alloy, the density of the core-and-yoke member is comparatively low and hence the saturation magnetic flux density of the same is comparatively low. In forming the core-and-yoke member by precision casting using a lost wax process, the core-and-yoke member is liable to be cracked by a stress induced by shrinkage, and hence the lost wax process is unsuitable. Since the Fe-Co magnetic alloy is brittle it is very difficult to form the core-and-yoke member having a complicated shape by machining. The core-and-yoke member can be formed by electrical discharge machining, in which an ingot of the Fe-Co magnetic alloy is subjected to electrical discharge machining. However, electrical discharge machining increases the manufacturing cost of the core-and-yoke member. Therefore, the core-and-yoke member disclosed in Japanese Patent Laid-open No. 60-87062 has problems in manufacturing process though satisfactory in performance, which makes the practical application of the core-and-yoke member difficult. Practically, the core-and-yoke member is fabricated by a lost wax process using a mixture of the Fe-Co magnetic alloy and an additive for reducing the brittleness of the Fe-Co magnetic alloy. However, the additive reduces the saturation magnetic flux density of the Fe-Co magnetic alloy. Such a core-and-yoke member is hardly satisfactory.

As is mentioned in Japanese Patent Laid-open No. 60-87062, when a plurality of the core-and-yoke members are arranged contiguously, magnetic interference occurs between the adjacent core-and-yoke members, and hence the adjacent core-and-yoke members cannot be simultaneously magnetized. Japanese Patent Laid-open No. 59-114068 discloses individual cores formed of the Fe-Co magnetic alloy and arranged individually on a permanent magnet. Accordingly, magnetic interference occurs hardly between the adjacent cores. However, the cores still have problems in fabricating the same by a lost wax process.

OBJECT AND SUMMARY OF THE INVENTION

Accordingly, it is a first object of the present invention to provide a release type dot print head employing Fe-Co magnetic alloy cores capable of being easily fabricated.

It is a second object of the present invention to provide a release type dot print head employing cores formed of plates of the Fe-Co magnetic alloy and capable of conducting the magnetic flux of a permanent magnet in a high magnetic flux density.

It is a third object of the present invention to provide a release type dot print head having cores arranged at increased intervals to prevent magnetic interference between the cores.

To achieve the objects of the invention, the present invention provides a release type dot print head comprising: a plurality of cores placed in solenoid coils and arranged on a plane; a plurality of armatures supported for swing motion, biased away from the corresponding cores and fixedly provided at the extremities thereof with needles; a yoke; and a permanent magnet disposed between the cores and the yoke so as to form closed magnetic paths; characterized in that the cores are formed of plates of a magnetic alloy containing iron and cobalt as the principal components, and a plurality of auxiliary cores formed of a magnetic material are provided respectively in close contact with the side surfaces of the corresponding cores and the permanent magnet.

Each core is formed of the magnetic alloy containing iron and cobalt as the principal components (hereinafter referred to as "Fe-Co magnetic alloy"), is in close contact with the permanent magnet at one end surface thereof, has a side surface magnetically connected to the permanent magnet by the auxiliary core having large side surfaces joining to the side surface of the core and the permanent magnet. Accordingly, the magnetic flux of the permanent magnet flows through the cores in a high magnetic flux density, and hence the force biasing the armatures in the printing direction is increased accordingly for printing operation at an increased printing speed. Since the arrangement of the cores with the auxiliary cores interposed between the adjacent cores increases the intervals between the cores to prevent magnetic interference between the adjacent cores and to curtail power consumption. Furthermore, since the cores are formed of the plates of the Fe-Co magnetic alloy in a simple morphology, any additive need not be added to the Fe-Co magnetic alloy, and the cores can be easily fabricated by pressing or the like.

BRIEF DESCRIPTION OF THE DRAWINGS

The above and other objects, features and advantages of the present invention will become more apparent from the following description taken in conjunction with the accompanying drawings, in which.

DETAILED DESCRIPTION OF THE PREFERRED EMBODIMENT

Figure 1:
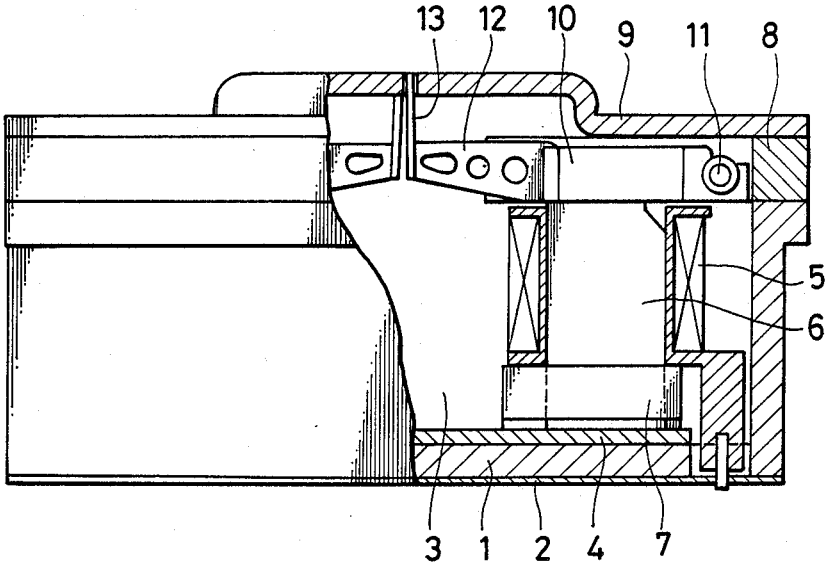
FIG. 1 is a partially cutaway front elevation of a release type dot print head embodying the present invention.

Referring to FIG. 1, there are shown a yoke 1 having an open end and a polygonal recess 3, a PC board 2 attached to the backside of the yoke 1, and a permanent magnet 4 fixed to the bottom surface of the recess 3 of the yoke 1. A plurality of cores 6 placed respectively in solenoid coils 5 and a plurality of auxiliary cores 7 are arranged on the periphery of the permanent magnet 4. An annular subyoke 8 is attached to the open end of the yoke 1. A holder 9 is fixed to the subyoke 8. A plurality of armatures 10 formed of a Fe-Co magnetic alloy having a high saturation magnetic flux density are fixed by brazing to the central portions of torsion bars 11 attached at the opposite ends thereof by brazing to the subyoke 8, respectively. Normally, the armatures 10 are attracted to the end surfaces of the cores 6, respectively, by the magnetic force of the permanent magnet 4, and thereby the torsion bars 11 are twisted resiliently to urge the armatures 10 in the printing direction. A finger 12 is attached to the extremity of each armature 10, and a needle 13 is attached by brazing to the extremity of the finger 12 so as to be slidably received in an opening formed in the central portion of the holder 9.

The core 6 and the auxiliary core 7 will be described hereinafter with reference to FIGS. 3 to 6. The core 6 is formed by shearing a rolled plate of the Fe-Co magnetic alloy having a high saturation magnetic flux density. The auxiliary core 7 is formed of a magnetic material and has a core holding portion and a base portion. The core holding portion has a wide contact surface 14 closely and fixedly joined to the side surface of the core 6, and the base portion has a wide contact surface 15 closely and fixedly joined to the permanent magnet 4 and an inclined surface 16 declining from the core supporting portion toward the edge of the base portion. The lower end 17, as viewed in FIG. 5, of the core 6 and the contact surface 15 of the auxiliary core 7 are attached closely by an adhesive to the permanent magnet 4. Since the contact surfaces 14 and 15 closely joined respectively to the side surface of the core 6 and the permanent magnet 4 are wide, the auxiliary core 7 need not be formed of a material having a particularly high saturation magnetic flux density, but may be a pure iron member formed by forging.

Figure 2:
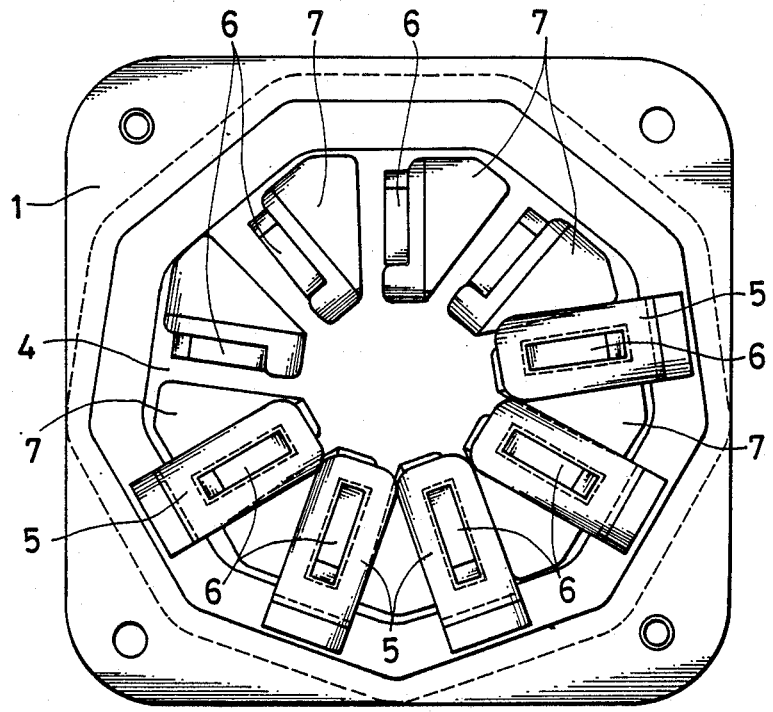
FIG. 2 is a plan view of the release type dot print head of FIG. 1, showing the arrangement of cores and yokes.
Figure 3:
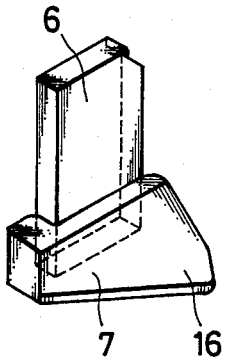
FIG. 3 is a perspective view showing a combination a core and an auxiliary core.
Figure 4:
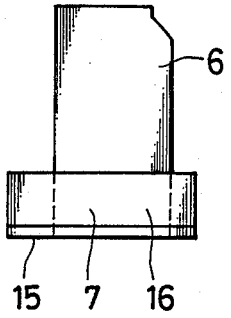
FIG. 4 is a front elevation of the combination of a core and an auxiliary core of FIG. 3.
Figure 5:
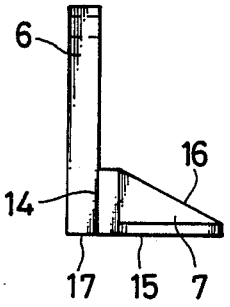
FIG. 5 is a side elevation of the combination of a core and an auxiliary core of FIG. 3.
Figure 6:
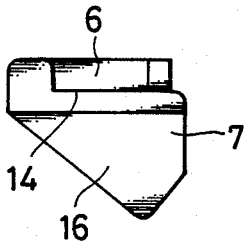
FIG. 6 is a plan view of the combination of a core and an auxiliary core of FIG. 3.

Referring to FIG. 2, the cores 6 are disposed in a circular arrangement at comparatively large angular intervals and the auxiliary cores 7 are disposed between the adjacent cores 6. A predetermined gap is formed between the core 6 and the auxiliary core 7 joined to the adjacent core 6. Since the base portion of the auxiliary core 7 has the inclined surface 16 declined toward the edge, the edge of the base portion of the auxiliary core 7 facing the adjacent core 6 has only a very small area.

The magnetic flux of the permanent magnet 4 flows directly and through the auxiliary core 7 through the cores 6, further through the armatures 10 and the subyoke 8 through the yoke 1, and returns to the permanent magnet 4. Thus, the armatures 10 are attracted to the cores 6 by the magnetic force of the permanent magnet 4. When the solenoid coil 5 is energized so as to cancel the magnetic force of the permanent magnet 4, the armature 10 is turned away from the core 6 by the resilience of the torsion bar 11, so that the needle 13 hits through an ink ribbon on a sheet on a platen to print a dot for character generation. Since the energization of the solenoid coil 5 is interrupted while the armature 10 is being turned in the printing direction, the armature 10 is attracted again to the core 6 by the magnetic force of the permanent magnet 4.

As mentioned above, the core 6 is formed of the Fe-Co magnetic alloy having a high saturation magnetic flux density, the lower end 17 of the core 6 is in close contact with the permanent magnet 4, the core 6 is connected magnetically to the permanent magnet 4 by the auxiliary core 7 attached to the side surface of the core 6, and the contact surfaces 14 and 15 of the auxiliary core 7 respectively in contact with the side surface of the core 6 and the permanent magnet 4 are wide. Accordingly, the magnetic flux of the permanent magnet 4 flows through the core 6 in a comparatively high magnetic flux density, and hence the resilience of the torsion bar 11 urging the armature 10 in the printing direction may be comparatively high, so that the release type dot print head is able to operate at an increased printing speed. Furthermore, the cores 6 are arranged at a comparatively large angular intervals since the cores 6 and the auxiliary cores 7 are arranged alternately, a comparatively large space is formed between the core 6 and the auxiliary core 7 attached to the adjacent core 6, the area of the surface of the edge of the base portion of the auxiliary core 7 facing the adjacent core 6 is very small since the base portion has the inclined surface 16 declining toward the edge thereof. Accordingly, when the magnetic force of the permanent magnet acting on the armature 10 is cancelled by energizing the solenoid coil 5, no magnetic flux flows through the adjacent core 6 and the auxiliary core 7 joined to the adjacent core 6, so that magnetic interference between the adjacent cores 6 does not occur and power consumption is reduced. Still further, formed of rolled plates of the Fe-Co magnetic alloy, the cores 6 have a very simple shape, a close texture and a high strength Accordingly, the Fe-Co magnetic alloy need not contain any additive for improving the brittleness and the cores 6 can be easily fabricated by pressing or the like.

What is claimed is:

1. A release type dot print head comprising:

a plurality of cores placed respectively in solenoid coils and arranged on a plane;

a plurality of armatures swingably supported, urged away from the corresponding cores and fixedly provided with needles at the extremities thereof, respectively;

a yoke; and a permanent magnet disposed between the cores and the yoke;

said cores, said armatures, said yoke and said permanent magnet forming magnetic paths;

wherein said cores are each formed of a plurality of plates of a magnetic alloy containing iron and cobalt as the principal components, and an auxiliary core associated with each of said cores is formed of a magnetic material which is different from that of said cores, said auxiliary cores being joined closely to the side surfaces of the cores and the permanent magnet, respectively.

2. A release type dot print head according to claim 1, wherein each of said auxiliary cores has a wide contact surface fixedly and closely joined to the side surface of the corresponding core, and a wide contact surface fixedly and closely joined to the permanent magnet.

3. A release type dot print head according to claim 1, wherein each of said auxiliary cores has a base portion having a contact surface fixedly and closely joined to the permanent magnet on the lower side thereof, and an inclined surface declining toward an edge of the base portion thereof so that the thickness of the base portion decreases gradually toward the edge thereof.

* * * * *